US010021917B2

(12) United States Patent
Dai et al.

(10) Patent No.: US 10,021,917 B2
(45) Date of Patent: Jul. 17, 2018

(54) ATOMIZER AND ELECTRONIC CIGARETTE HAVING SAME

(71) Applicant: Shenzhen First Union Technology Co., Ltd., Shenzhen, Guangdong Province (CN)

(72) Inventors: Changzheng Dai, Shenzhen (CN); Yonghai Li, Shenzhen (CN); Zhongli Xu, Shenzhen (CN)

(73) Assignee: Shenzhen First Union Technology Co., Ltd. (CN)

( * ) Notice: Subject to any disclaimer, the term of this patent is extended or adjusted under 35 U.S.C. 154(b) by 0 days.

(21) Appl. No.: 15/796,836

(22) Filed: Oct. 29, 2017

(65) Prior Publication Data

US 2018/0116287 A1 May 3, 2018

(30) Foreign Application Priority Data

Oct. 31, 2016 (CN) ..... 2016 2 1153234 U

(51) Int. Cl.
*A24F 13/00* (2006.01)
*A24F 47/00* (2006.01)
*H05B 3/44* (2006.01)

(52) U.S. Cl.
CPC ..... *A24F 47/008* (2013.01); *H05B 3/44* (2013.01)

(58) Field of Classification Search
CPC ..... A24F 47/008; A24F 47/002; H05B 3/44
USPC ..... 131/329, 328
See application file for complete search history.

(56) References Cited

U.S. PATENT DOCUMENTS

2017/0119060 A1* 5/2017 Li ..... A24F 47/008
2017/0281883 A1* 10/2017 Li ..... A61M 15/0001
2017/0297892 A1* 10/2017 Li ..... B65D 47/265
2018/0125118 A1* 5/2018 Chen ..... H05B 3/44

* cited by examiner

*Primary Examiner* — Hae Moon Hyeon
(74) *Attorney, Agent, or Firm* — PROI Intellectual Property US

(57) ABSTRACT

An atomizer includes a main body and an atomizing device detachably connected to the main body. The main body defines a liquid chamber. The atomizing device includes an atomizing core and a first connecting holder. The first connecting holder is configured for supporting the atomizing core. The first connecting holder is configured for connecting with the main body in a rotatable manner. The atomizing device further includes a second connecting holder movable between a first position and a second position along an axial direction. When the second connecting holder is in the first position, the second connecting holder is rotatable relative to the first connecting holder. When the second connecting holder is in the second position, the second connecting holder is capable of driving the first connecting holder to rotate, so that the first connecting holder can be detached from the main body.

10 Claims, 4 Drawing Sheets

ATOMIZER AND ELECTRONIC CIGARETTE HAVING SAME

CROSS REFERENCE TO RELATED APPLICATIONS

The present application claims priority to Chinese Patent Application CN 2016 211 532 34.0 filed on Oct. 31, 2016.

TECHNICAL FIELD

The present disclosure relates to smoking sets, and particularly, to an atomizer with a replaceable atomizing core, and an electronic cigarette.

BACKGROUND

In related art, a typical atomizer includes a detachable atomizing core structure. One end of the atomizing core is connected to a main body of the atomizer via a holder, and the other end of the atomizing core is connected to a power supply, thus forming an electronic cigarette. Since the atomizer does not include a child lock, the atomizing core may be detached due to incorrect operation by a child. Accordingly, tobacco liquid may flow out and be taken by the child by mistake. The atomizing core and the main body of the atomizer are connected via screw threads, and the power supply and the atomizing core are connected via screw threads of same direction as that between the atomizing core and the main body. Therefore, the atomizing core may be detached by mistake when separating the power supply, thus rendering liquid leakage.

SUMMARY

An atomizer includes a main body and an atomizing device detachably connected to the main body. The main body defines a liquid chamber. The atomizing device includes an atomizing core and a first connecting holder. The first connecting holder is configured for supporting the atomizing core. The first connecting holder is configured for connecting with the main body in a rotatable manner. The atomizing device further includes a second connecting holder movable between a first position and a second position along an axial direction. When the second connecting holder is in the first position, the second connecting holder is rotatable relative to the first connecting holder. When the second connecting holder is in the second position, the second connecting holder is capable of driving the first connecting holder to rotate, so that the first connecting holder can be detached from the main body.

DETAILED DESCRIPTION

The present disclosure will be described in detail as follows in view of several embodiments and the accompanying drawings.

Figure 1:
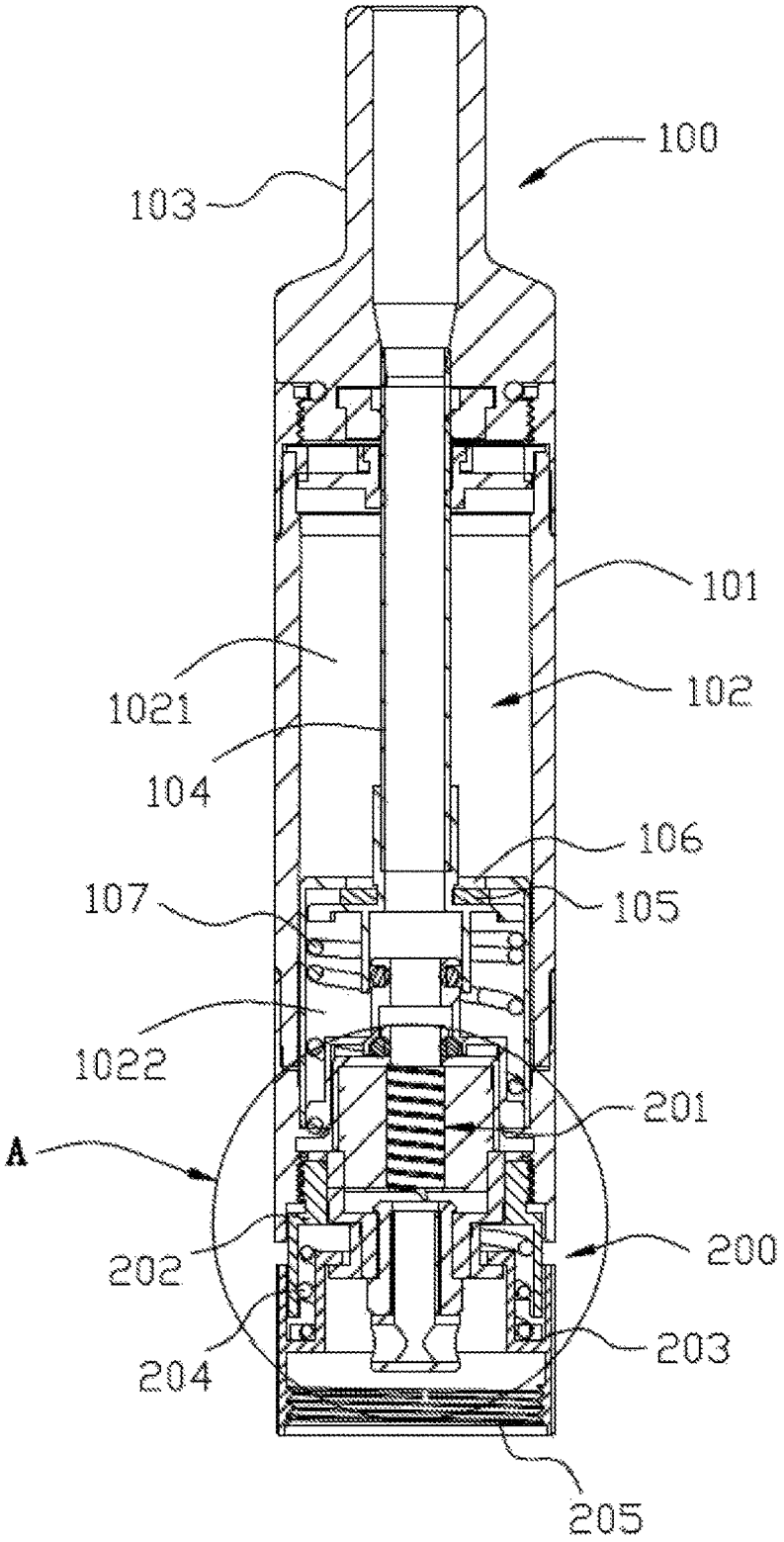
FIG. 1 is a structural schematic view of an atomizer with a replaceable atomizing core according to an embodiment.
Figure 2:
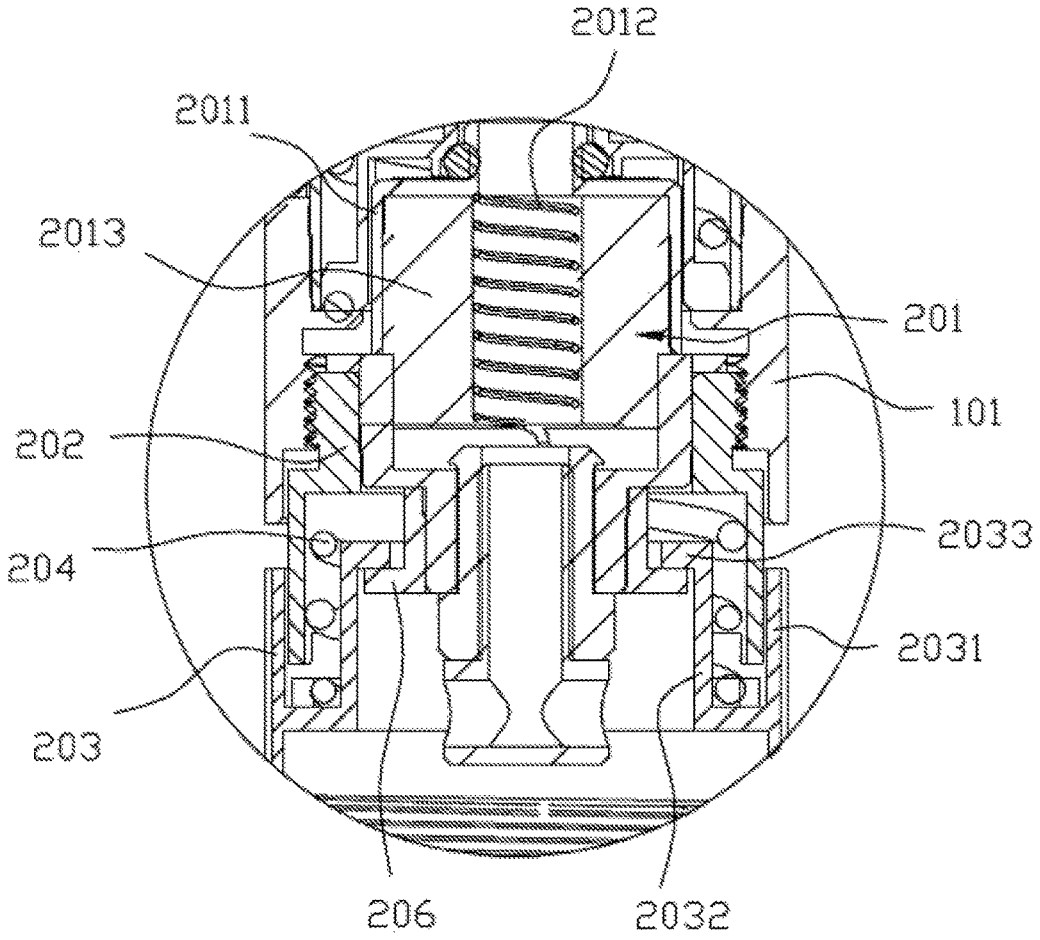
FIG. 2 is an enlarged view of part A of the atomizer of FIG. 1.

Referring to FIGS. 1-2, an atomizer 100 with a replaceable atomizing core is shown. The atomizer 100 includes a main body 101 and an atomizing device 200 detachably connected to the main body 101. The main body 101 defines a liquid chamber 102 inside configured for storing tobacco liquid. A top end of the main body 101 is provided with a mouthpiece 103 for user to inhale aerosol. An air pipe 104 is provided in the liquid chamber 102, and configured for connecting the atomizing device 200 and the mouthpiece 103.

The atomizing device 200 includes an atomizing core 201 and a first connecting holder 202. The atomizing core 201 is configured for aerosolized the tobacco liquid in the liquid chamber 102 to form aerosol. The first connecting holder 202 is configured for supporting the atomizing core 201. The first connecting holder 202 is configured to connect the main body 101 in a rotating fashion. When the first connecting holder 202 is connected to the main body 101, the atomizing core 201 inserts into the liquid chamber 102, and is connected with a bottom end of the air pipe 104. The aerosol formed by the atomizing core 201 is expelled to the mouthpiece 103 via the air pipe 104.

The atomizing device 200 further includes a second connecting holder 203. The second connecting holder 203 is at least movable between a first position and a second position along an axial direction of the second connecting holder 203. When the second connecting holder 203 is in the first position, the second connecting holder 203 and the first connecting holder 202 are coupled to form a restrained state along a circumferential direction, and the second connecting holder 203 is capable of driving the first connecting holder 202 to rotate, thus detaching the first connecting holder 202 from the main body 101. In the present embodiment, the second connecting holder 203 partially surrounds the first connecting holder 202. In a natural state, the second connecting holder 203 is in the first position, and the second connecting holder 203 and the first connecting holder 202 are not in a restrained state in a circumferential direction. When a child rotates the second connecting holder 203, the atomizing device 200 cannot be detached, thus avoiding liquid leakage and risk of taking the tobacco liquid by the child by mistake. When the second connecting holder 203 is moved axially to the second position, the second connecting holder 203 and the first connecting holder 202 are coupled to form a restrained state along a circumferential direction. Only in this state, the atomizing device 200 can be detached by rotating the second connecting holder 203.

Quite usefully, a restoring spring 204 is arranged between the first connecting holder 202 and the second connecting holder 203. The restoring spring 204 is configured for driving the second connecting holder 203 to return to an initial position. The restoring spring 204 is capable of keeping the movable second connecting holder 203 always in the first position. When the second connecting holder 203 is pushed upwards and released, the restoring spring 204 is capable of driving the second connecting holder 203 to the first position. In the present embodiment, the first connecting holder 202 is threadedly coupled to the main body 101. Similarly, the second connecting holder 203 includes screw threads 205 configured for connecting with a power supply. When the power supply is coupled to the second connecting holder 203 via screw threads, and the second connecting holder 203 is in the first position (i.e., the natural state), the atomizing device 200 cannot be detached by rotating the power supply, thus avoiding liquid leakage caused by incorrect operation. Of course, the rotating connecting manner can be replaced by a rotating snap-fit connection.

Quite usefully, the second connecting holder 203 includes an outer tube 2031 and an inner tube 2032, and the outer tube 2031 and the inner tube 2032 are integrally formed. The outer tube 2031 forms part of a housing of the atomizer 100, and partially surrounds the first connecting holder 202. The user can only touch the outer tube 2031 and an outer surface of the main body 101, and cannot touch the first connecting holder 202. The restoring spring 204 is received in a gap between the outer tube 2031 and the inner tube 2032. Two ends of the restoring spring 204 abut against the first connecting holder 202 and the second connecting holder 203, respectively.

To make the first connecting holder 202 rotatable and axially movable in a certain stroke relative to the second connecting holder 203, the atomizing device 200 further includes a flange 206, and a position between the flange 206 and the first connecting holder 202 is relatively fixed. The inner tube 2032 extends inward to form an annular part 2033, and the annular part 2033 is coupled with the flange 206 to form a snap-fit connection. Upon the force of the restoring spring 204, in the first position (i.e., the natural state), a bottom surface of the annular part 2033 is in tight contact with a top surface of the flange 206.

Figure 3:
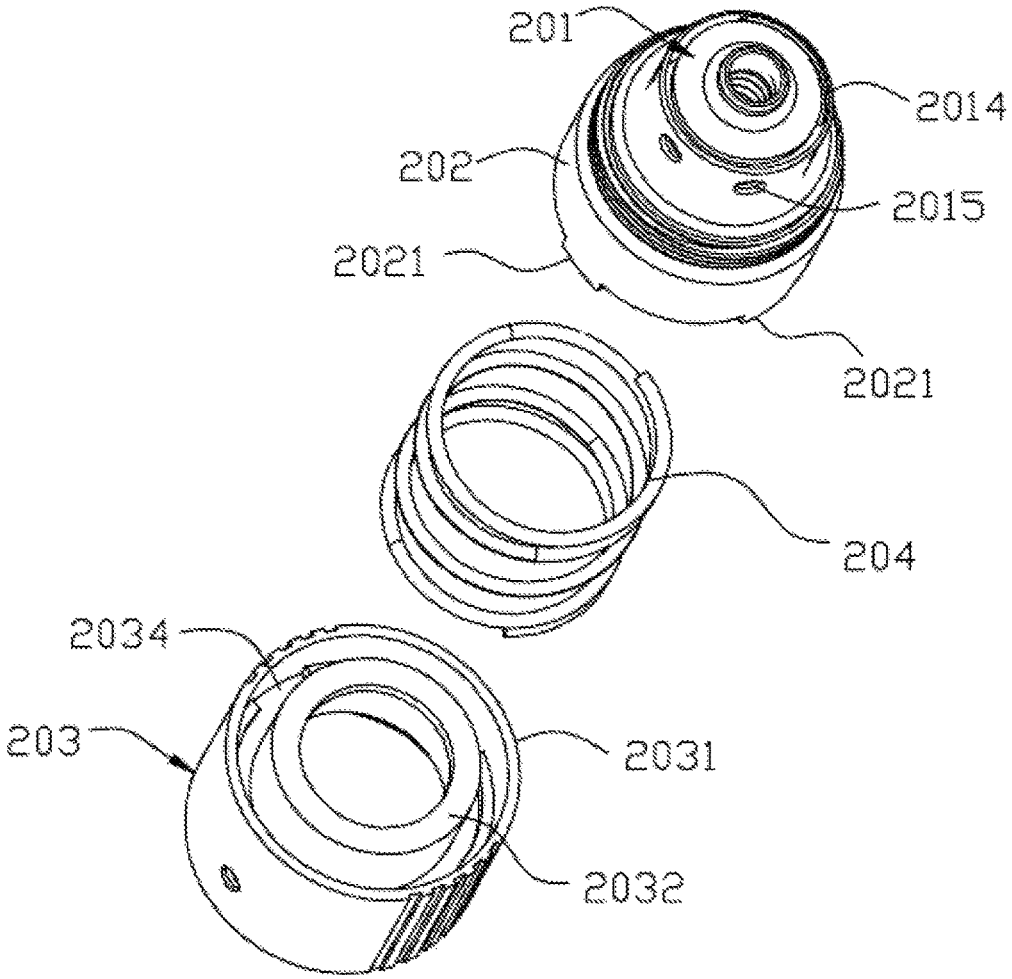
FIG. 3 is an exploded perspective view of the first connecting holder and the second connecting holder of the atomizing device according to the embodiment.

Referring to FIGS. 2-3, as a detailed connection between the first connecting holder 202 and the second connecting holder 203, the first connecting holder 202 includes at least one protruding stage 2021 at an end facing the second connecting holder 203, and the second connecting holder 203 defines a corresponding notch 2034. When the second connecting holder 203 is moved so that the protruding stage 202 is engaged in the notch 2034, a rotation between the second connecting holder 203 and the first connecting holder 202 is limited. In this state, the second connecting holder 203 is in the above-described second position.

In the present embodiment, the atomizing core 201 includes a housing frame 2011, a heating element 2012, and a liquid conducing body 2013 surrounding the heating element 2012. In detail, the heating element 2012 is a spiral heating wire, the liquid conducting body 2013 is made of cellucotton or porous material, and configured for absorbing the tobacco liquid from the liquid chamber 102, and delivering the tobacco liquid to the heating element 2012. Quite usefully, the housing frame 2011 defines a liquid inlet 2014 in a top surface of the housing frame 2011, and further defines a plurality of liquid inlets 2015 in a side surface of the housing frame 2011. Therefore, the tobacco liquid can permeate the liquid conducting body 2013 more fully and evenly.

Referring to FIG. 1 again, the atomizer 100 is refillable. When the mouthpiece 103 is detached, tobacco liquid can be filled into the liquid chamber 102. In the present embodiment, the liquid chamber 102 is divided into a top liquid chamber 1021 and a bottom liquid chamber 1022, the top liquid chamber 1021 is in communication with the bottom liquid chamber 1022 via a liquid hole 106, and the atomizing core 201 is arranged in the bottom liquid chamber 1022. A bottom end of the air pipe 104 extends into the bottom liquid chamber 1022 from the top liquid chamber 1022. A sealing element 105 is provided at a bottom end, and configured for sealing the liquid hole 106. A spring 107 is provided abutting against the bottom end of the air pipe 104. In liquid injecting process, the sealing element 105 seals the liquid hole 106 upon an upward elastic force by the spring 107. In this state, the tobacco liquid is kept in the top liquid chamber 1021, and will not flow into the bottom liquid chamber 1022. When liquid injection is finished and the mouthpiece 103 is assembled to the main body 101, the mouthpiece 103 pushes the air pipe 104 downwards, thus driving the sealing element 105 to move downwards. Accordingly, the liquid hole 106 is opened, so that the tobacco liquid flows into the bottom liquid chamber 1022.

Figure 4:
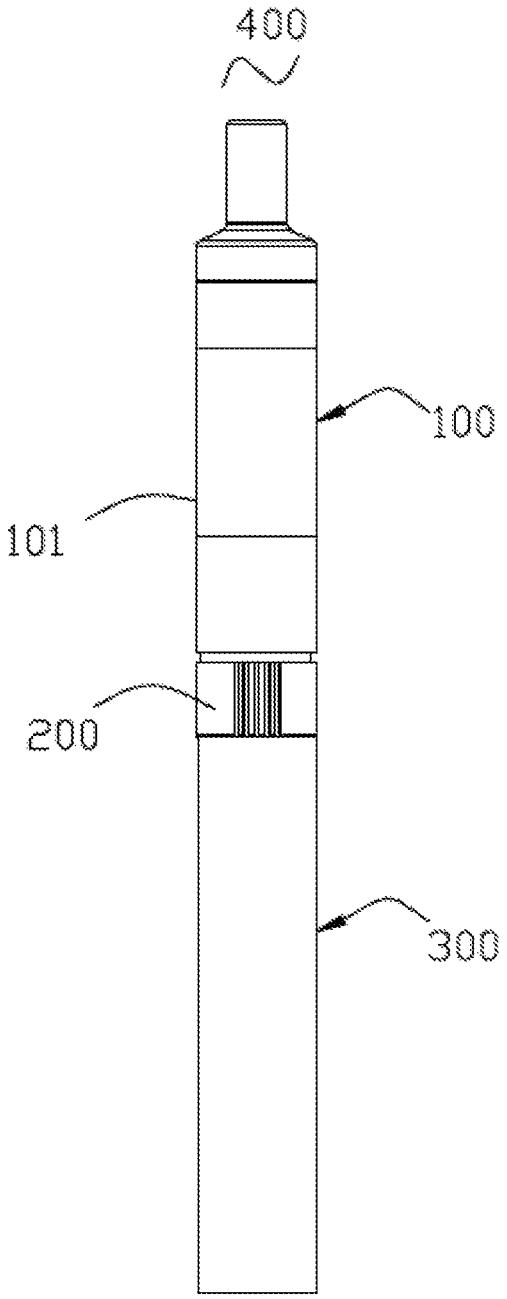
FIG. 4 is a schematic view of an electronic cigarette according to the embodiment.

Referring to FIG. 4, an electronic cigarette 400 is shown. The electronic cigarette 400 includes a power supply 300 and the above-described atomizer 100. The structure of the atomizer 100 will not be described. The power supply 300 is connected to the second connecting holder 203, and is configured for feeding the atomizing core 201 power. In the natural state, the atomizing device 200 cannot be disengaged when the user holds the power supply and rotates the power supply 300, thus avoiding liquid leakage caused by incorrect operation. To detach the atomizing device 200 or replace the internal atomizing core 201, the power supply 300 or the atomizing device 200 is grabbed and exerted an upward force, and is then rotated to detach the atomizing device 200 from the main body 101.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. An atomizer with a replaceable atomizing core, comprising:

a main body; and an atomizing device detachably connected to the main body, the main body defines a liquid chamber configured for storing tobacco liquid, the atomizing device comprising an atomizing core and a first connecting holder, the atomizing core being configured for atomizing the tobacco liquid in the liquid chamber to form aerosol, the first connecting holder being configured for supporting the atomizing core, the first connecting holder being configured for connecting with the main body in a rotatable manner;

wherein the atomizing device further comprises a second connecting holder, the second connecting holder is movable at least between a first position and a second position along an axial direction of the second connecting holder;

when the second connecting holder is in the first position, the second connecting holder is rotatable relative to the first connecting holder; when the second connecting holder is in the second position, the second connecting holder and the first connecting holder are in a restrained state along a circumferential direction, and the second connecting holder is capable of driving the first connecting holder to rotate, so that the first connecting holder can be detached from the main body.

2. The atomizer according to claim 1, wherein the first connecting holder comprising at least one protruding stage at an end facing the second connecting holder, the second connecting holder defines a notch corresponding to the at least one protruding stage, when the second connecting holder is moved so that the at least one protruding stage is engaged in the notch, a rotation between the second connecting holder and the first connecting holder is limited.

3. The atomizer according to claim 1, further comprising a restoring spring between the first connecting holder and the second connecting holder, wherein the restoring spring is configured for driving the second connecting holder to return to an initial position.

4. The atomizer according to claim 3, wherein the second connecting holder comprises an outer tube and an inner tube, the outer tube forms part of a housing of the atomizer, and the restoring spring is arranged between the outer tube and the inner tube.

5. The atomizer according to claim 4, wherein the atomizing device further comprises a flange, the inner tube comprises an annular part extending inwards from the inner tube, and the annular part is engaged with the flange to form a snap-fit connection.

6. The atomizer according to claim 1, wherein the first connecting holder is connected to the main body via screw threads.

7. The atomizer according to claim 1, wherein the second connecting holder comprises screw threads configured for connecting a power supply.

8. The atomizer according to claim 1, wherein the atomizing core comprises a housing frame, a heating element, and a liquid conducting body surrounding the heating element.

9. The atomizer according to claim 8, wherein the housing frame defines liquid inlets at a side surface and a top surface.

10. An electronic cigarette, comprising:

a power supply; and the atomizer according to claim 1, wherein the power supply is connected to the second connecting holder, and configured for supplying the atomizing core power.

* * * * *